US007488241B2

(12) United States Patent
Elek et al.

(10) Patent No.: US 7,488,241 B2
(45) Date of Patent: Feb. 10, 2009

(54) PRECISION CONTROL OF SHARPENING ANGLES

(75) Inventors: Bela Elek, Wilmington, DE (US); Daniel D. Friel, Sr., Greenville, DE (US)

(73) Assignee: Edgecraft Corp., Avondale, PA (US)

( * ) Notice: Subject to any disclaimer, the term of this patent is extended or adjusted under 35 U.S.C. 154(b) by 238 days.

(21) Appl. No.: 11/535,695

(22) Filed: Sep. 27, 2006

(65) Prior Publication Data

US 2007/0077872 A1 Apr. 5, 2007

Related U.S. Application Data

(60) Provisional application No. 60/722,777, filed on Sep. 30, 2005.

(51) Int. Cl.
*B24B 7/00* (2006.01)

(52) U.S. Cl. ..... 451/293; 451/231; 451/234; 451/278

(58) Field of Classification Search ..... 451/293, 451/231, 234, 278
See application file for complete search history.

(56) References Cited

U.S. PATENT DOCUMENTS

| | | | | |
|---|---|---|---|---|
| 288,099 | A | | 11/1883 | Myers |
| 928,755 | A | * | 7/1909 | Henderson ..... 69/16 |
| 4,627,194 | A | | 12/1986 | Friel |
| 4,716,689 | A | | 1/1988 | Friel |
| 4,807,399 | A | | 2/1989 | Friel |
| 4,897,965 | A | | 2/1990 | Friel |
| 5,005,319 | A | | 4/1991 | Friel |
| 5,148,634 | A | | 9/1992 | Bigliano |
| 5,245,791 | A | | 9/1993 | Bigliano |
| 5,357,717 | A | | 10/1994 | Friel |
| 5,390,431 | A | | 2/1995 | Friel |
| 5,404,679 | A | | 4/1995 | Friel |
| 5,449,315 | A | | 9/1995 | Friel |
| 5,582,535 | A | | 12/1996 | Friel |
| 5,611,726 | A | * | 3/1997 | Friel et al. ..... 451/177 |
| 5,868,611 | A | | 2/1999 | Friel |
| 5,947,805 | A | * | 9/1999 | Van Osenbruggen ..... 451/358 |
| 6,012,971 | A | | 1/2000 | Friel |
| 6,113,476 | A | | 9/2000 | Friel |
| 6,267,652 | B1 | | 7/2001 | Friel |
| 6,726,551 | B2 | | 4/2004 | Friel |
| 6,863,600 | B2 | | 3/2005 | Friel |
| 6,875,093 | B2 | | 4/2005 | Friel |
| 6,881,137 | B2 | | 4/2005 | Friel |

* cited by examiner

*Primary Examiner*—Joseph J. Hail, III
*Assistant Examiner*—Shantese McDonald
(74) *Attorney, Agent, or Firm*—Connolly Bove Lodge & Hutz

(57) ABSTRACT

A modified truncated cone-shaped disk is molded onto a plastic hub which is mounted on a motor driven shaft. The hub has an axial bore of a size to fit with very close clearance on the shaft while still permitting the disk to freely slide against a low spring force.

7 Claims, 1 Drawing Sheet

PRECISION CONTROL OF SHARPENING ANGLES

CROSS REFERENCE TO RELATED APPLICATION

This application is based on provisional application Ser. No. 60/722,777, filed Sep. 30, 2005.

FIELD OF THE INVENTION

This invention pertains to an improved low cost means of obtaining precision control of sharpening angles in electric knife and blade sharpeners.

BACKGROUND OF THE INVENTION

There have been a wide variety of powered knife sharpeners introduced to the market that depend for their performance upon relatively precise control of the sharpening angle. The accuracy of angular control in such devices commonly is inadequate to take full advantage of the edge sharpness that can be achieved with ultrafine abrasives.

The ultimate precision of electric sharpeners that use abrasives to create the final knife edge depends critically on the size of the abrasive particles that are used to abrade the final edge and on the precision of all mechanical and structural elements that are directly involved in establishing and maintaining consistently the sharpening angle between the plane of each final edge facet and the plane of the abrasive sharpening surface.

As described in U.S. Pat. No. 6,875,093 as finer, smaller grit, abrasive particles are used in precision sharpeners in order to obtain a smoother hence more polished surface on the facets of the blade being sharpened, it becomes necessary to reduce the pressure applied to the edge facet during sharpening in order to minimize the size of the burr created at the edge and to avoid "loading" of the abrasive surface composed of ultrafine particles. Also to realize the ultimate precision as the moving abrasive surface machines the facet the angular relationship of the plane of the moving abrasive surface at the point of contact with the facet must be held precisely at the same angle throughout each physical stroke or repetitive motion of the abrasive surface. If the active abrasive surface is in the form of rotating circular structure such as a disk, FIG. 1, the spacial precision of the moving circular line of contact between the facet and the disk surface places a limit on the consistency of the sharpening angle. If the spacial precision is high then the sharpening angle will remain very consistent during each revolution of the line of contact between the facet surface and the moving abrasive surface. Higher angular precision results in sharper edges on the knives.

U.S. Pat. No. 6,875,093 emphasizes that when springs such as spring 5 (FIG. 1) of lower force constant are used to reduce the pressure during sharpening with a disk 2 covered with ultrafine abrasives, any small mechanical imperfections in the surface of rotation will cause serious vibrations, intermittent contact with the facet and variations in the sharpening angle as the contacting abrasive surface goes through each cycle of its motion.

If the abrasive surface is established on the surface of a rotating disk-like surface, (FIG. 1) any runout (wobble) of that surface, about its axis of disk rotation, and any micro or macro imperfections in that disk-like surface of rotation can cause significant changes in the sharpening angle during each rotation cycle. Such angular changes deteriorate the precision with which the facet surface is machined. Changes in the sharpening angle on each cycle limit the precision with which the edge (intersection line of the two facets) is formed and hence establish the obtainable sharpness of the edge and the size of burr that is created along that edge. With a more consistent sharpening angle, the residual burr will be smaller and the smaller the residual burr the sharper the knife edge will be.

SUMMARY OF THE INVENTION

An object of this invention is to provide precision control of the sharpening angles in an electric knife and blade sharpener based upon an advance beyond the techniques described in U.S. Pat. No. 6,875,093, all of the details of which are incorporated herein by reference thereto.

As an example of this invention relatively thin modified truncated cone shaped disks are molded onto hubs which are mounted on a motor driven shaft. The hubs have bores which fit with very small clearance on such shafts yet provide enough clearance to allow the disks to slide freely against low force springs when contacted by the facet of a knife.

THE DRAWINGS

DETAILED DESCRIPTION

Figure 5:
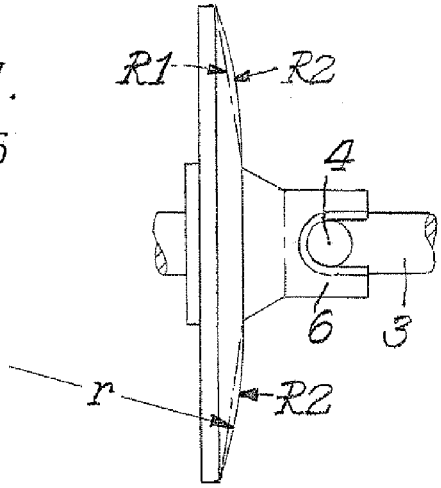
FIG. 5 is a side elevational view that illustrates use of an improved surface structure on the disk in accordance with this invention.
Figure 6:
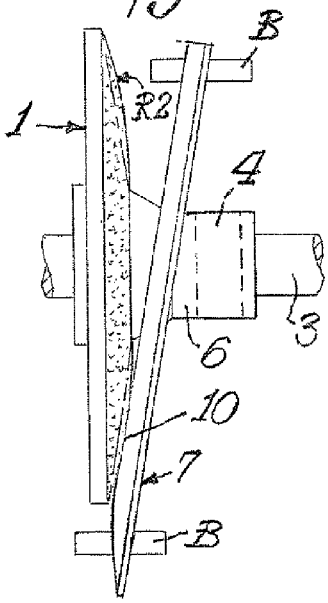
FIG. 6 is a top plan view of the disk of FIG. 5 showing a blade being sharpened.
Figure 7:
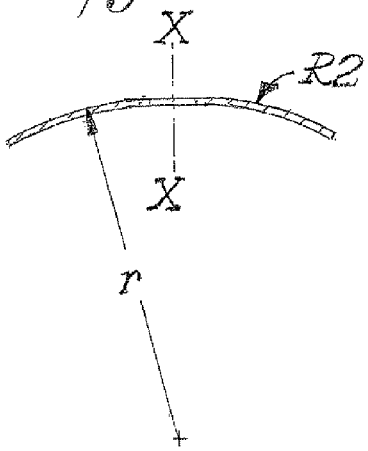
FIG. 7 is a cross sectional view of a sharpening disk with a modified (curved) surface according to this invention.

We have found that a relatively economic construction and practical sharpening surface for powered sharpeners can be created using relatively thin modified truncated cone shaped surfaced disks of FIGS. 5, 6 and 7 that are molded onto plastic hubs 6 designed for mounting by means of pins 4 on a motor driven shaft 3 of highly precise diameter. The plastic hubs are molded with precise diameter bores to fit with very small clearance on such shafts—just enough clearance to allow the disks to slide freely against low force springs 5 when contacted by the facet of a knife being sharpened. Such low force would be less than 0.2 pounds. The precision close-fitting diameter drive shafts and mating holes in mounting hubs as described in U.S. Pat. No. 6,875,093 also are important in order to reduce the runout of the rotating line of contact on each rotation of the disk.

In order to further increase the precision and consistency of the angular contact between the edge facet of the blade and the rotating abrasive surface these inventors have found that the conical slope of a normal truncated abrasive coated cone surface 2 can be modified slightly as described later to a slightly curved shape, R2, FIGS. 5, 6 and 7 to insure with greater accuracy exactly where on that rotating surface the facet will make its contact while sharpening. The contact point is better defined and it remains relatively much more consistent on each rotation, thereby establishing a more consistent angular relationship between the edge facet of the blade and the plane of the abrasive surface.

Figure 1:
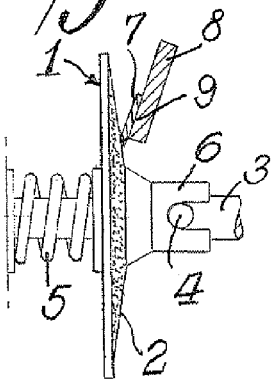
FIGS. 1-2 are side and front elevational views of a rotating sharpening disk and its associated structure and show a knife blade against the disk in accordance with this invention.
Figure 2:
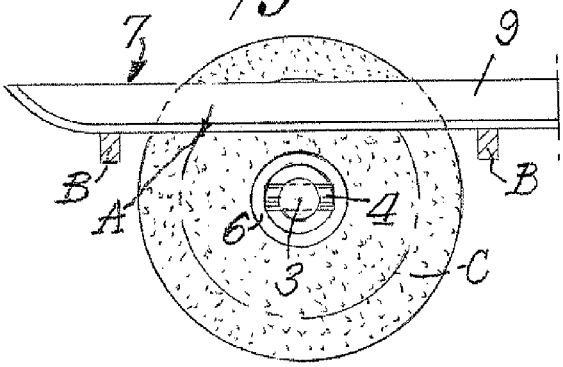

Characteristically the face 9 of blade 7 (FIGS. 1 and 2) is guided angularly by means of a rigidly mounted guide surface 8 (FIG. 1) so that one edge facet of the knife is positioned steadily at a fixed angle as it contacts the abrasive covered disk surface 2. Thus one facet of the cutting edge is held in intimate contact with the surface 2 of the motor driven disk 1 at a contact point such as point A (FIG. 2). The blade shown in cross section in FIG. 1 is actually not aligned parallel to the back of disk 1 but is oriented so that the blade facet makes contact with the abrasive surface approximately at point A (FIG. 2) on an upper front quadrant of the abrasive surface 2. The direction of rotation of the abrasive surface is commonly but not necessarily, counter clockwise as viewed in FIG. 2.

We have found in such configurations it is important to have non-abrasive rests or stops B (FIGS. 2 and 6) that contact the edge 10 of blade 7 and align the edge in the "horizontal" plane to consistently contact the abrasive surface at point A. Any runout (wobble) or surface irregularity of the abrasive disk 1 will cause the knife-edge contact point A to shift significantly during each rotation of the abrasive coated surface 2. Any shift of point A can change the angle of contact between the plane of the edge facet and the plane of the nominally conical abrasive surface 2. We have found however that the amount of lateral shift in the position of the contact point A and consequently the change in the angle of the facet being formed can be minimized by creating a slightly rounded (crowned) surface on the nominally truncated conical surface as described below.

Figure 3:
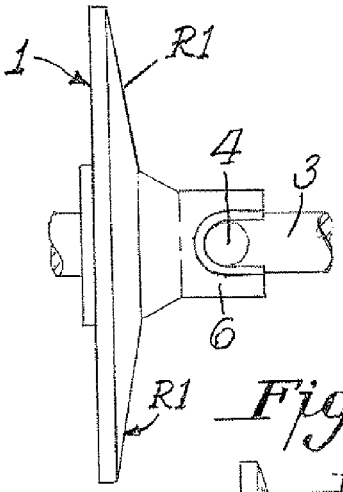
FIGS. 3-4 are side and front elevational views similar to FIGS. 1-2 without the knife blade.
Figure 4:
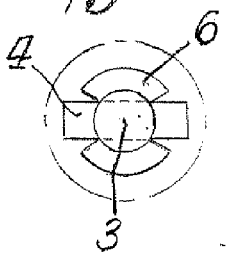

The improvement which we have made to the normal truncated abrasive cone surface shown in FIG. 3, modifies the straight conical slope line R1 of the normal truncated cone surface of FIG. 3 by making it slightly curved as shown by line R2 in FIGS. 5, 6 and 7. The curved line R2 would preferably have a very large radius r as shown in FIG. 5, 6 and FIG. 7. The disk shown in FIG. 7 is a thin metal disk with a modified truncated cone cross section with a large radius curved surface R2 which is abrasive coated, preferably with fine diamond abrasive particles and crosses the axis x-x. The disk is mounted on a hub 6 rotated about its central axis in the manner shown in FIGS. 1 thru 6. This slight curvature of line R2 which is perpendicular to the circumferential circle of facet contact (FIG. 3) reduces significantly the wandering of point A on each revolution of the modified truncated cone surface and reduces any variation of the contact angle between the abrasive coated surface and the edge facet being formed. A variety of surface geometries can be used to provide this slightly convex surface, but this modified truncated cone surface as described here is an illustration of one workable surface geometry. The important characteristic of the modified truncated cone surface is that it be slightly crowned in that area A where the edge facet contacts the cone surface.

A slight crown is sufficient to stabilize the area of contact between the facet and the rotating abrasive surface so that a stabilized circumferential circle of contact C, FIG. 2 is established on the rotating surface thus insuring a more consistent sharpening angle and a steady non-vibrating contact for the knife edge facet during each revolution.

It has been demonstrated that the perfection of a cutting edge can be enhanced significantly as it is sharpened if the edge facet is created in successive steps. It is desirable to sharpen the entire facet surface in a first step at a first angle with a relatively coarse abrasive which can quickly reshape the entire facet, then in a second step reshape the lower portion of the facet with a finer abrasive at a slightly larger second angle, and then in an optimum situation polish or hone the approximate lower third of the initial facet at a still larger third angle with an ultrafine abrasive. The quality of the final edge so formed depends heavily on the size of the final grit and on the consistency of the angle of the facet against the abrasive surface throughout each rotation of that surface. Variation of the sharpening angle during even a fraction of each rotation can reduce the quality and perfection of the final knife edge.

In sharpeners designed to use ultrafine abrasives (i.e., less than 0.002 inch in diameter) the full potential of such abrasives cannot be realized unless the angular relationships of the abrasive surface and the facet being sharpened are maintained on successive rotary cycles and throughout each individual cycle with great precision and consistency. That precision and consistency is enhanced by creating the described large convex radius on the radial lines running down the slope of a rotating truncated cone surface. That radius is nominally perpendicular to the circumferential circle of contact C (FIG. 3). That radius must be large enough to spread out the contact area of the edge facet sufficiently to avoid excessive localized wear of the contacting fine grit abrasive surface. A radius on the order of 8 to 12 inches worked very well creating substantially improved cutting edges. Longer radii surfaces can be used but longer radii require greater precision of the surface forming means to achieve equally good edges.

These techniques become very important as finer grit abrasives are employed, however in order that smaller particles be practical and effective over extended periods of use the abrasive must be an extremely hard low-wear material such as diamond. These techniques are impractical or less effective if softer abrasives are used because these will not hold the fidelity of the underlying crowned shape with significant use. For example carborundum, alumina, and silica wheels or disks proved to be less practical because of their granularity and reduced durability. Surfaces coated with micron size diamonds proved demonstrably more precise and with normal care they hold their shape indefinitely.

If diamond abrasives are used, this new technique works well. In order to sharpen the edge facets step-wise as described above with successively finer grits in each step and with the successive sharpening angles very close to each other—for example only one or two degrees apart, the use of a hard abrasive such as diamonds becomes close to mandatory. Other materials as they wear will allow the sharpening angles to change until the differential angle between successive steps becomes too small to allow this step-wise sharpening technique to be effective.

By combining this level of precision angle control and by using low wear diamonds for the abrasive, sharpening successively at angles only slightly different with ever finer grits become quite practical. We have shown that with the technique described here, the use of smaller, ultrafine diamonds that are less aggressive but which generate sharper edges are now practical in relatively economically priced powered sharpeners.

This technique is particularly practical for sharpening Asian styled blades that are much thinner at the point where the facets are formed and where some of the edges are single sided and hence have a facet sharpened primarily on one side of the blade. The optimum sharpening techniques required for such blades depends on using less aggressive and more precise sharpening methods using ultrafine abrasives.

The optimum use of these techniques rely on optimum shaping of the revolving abrasive surface, precise positioning and angular alignment of the knife blade to hold its facet at a consistent angle and in sliding contact with the moving abrasive surface, with the abrasive particles passing the facet preferably in a direction that is 30-90 degrees to the line of the knife edge and with the edge supported by appropriate rests or stops that position and maintain the contact point at an optimum location A on the moving abrasive surface throughout each revolution. Also the spring tension holding the facet in contact with the moving abrasive surface must be small and optimized for best results. The differential angle between successive grits must be reasonably small, less than 3 degrees, in order to minimize the size of the remaining burr if any along the resulting edge.

The inventors have found that the unique combination of these design elements with very hard abrasives result in final edges on a variety of conventional domestic and Asian knives that are consistently razor sharp.

What is claimed is:

1. In a knife sharpener for creating ultra sharp, smooth and polished edges by stabilizing the position of the knife edge as it is sharpened, comprising a motor driven symmetrically shaped abrasive surfaced disk mounted on a rotating shaft for sharpening a knife with one or more edge facets adjacent its two knife faces, said abrasive surface comprising ultrafine particles less than 0.002 inch in diameter, said disk surface having a truncated cone shape modified with its conical sloping radial side surface slightly crowned in a direction nominally perpendicular to the rotational circumferential line of contact on said disk surface with the knife facet being sharpened on that abrasive surfaced disk, said disk mounted opposite an elongated precision angle guide for sustained sliding contact with the face of the knife to position a knife edge facet in precise angular contact solely with the crowned area of said abrasive surfaced disk, said disk mounted to a hub, and said hub being mounted displaceably slidingly along the motor driven shaft against a resilient spring-like element with a force less than 0.2 pound to maintain sustained abrading contact with the facet.

2. The sharpener of claim 1 including at least one non-abrasive stop contacted by the edge of the knife that serves to locate and control the spacial point of contact of the edge facet with the sloping surface of the rotating abrasive surfaced disk and thus create a well defined rotational line of contact of the facet with said disk.

3. The sharpener of claim 1 where the point of contact of the edge facet with the rotating abrasive surfaced disk causes the abrasive particles to cross the facet at an angle of 30 to 90 degrees to the line of the knife edge.

4. The sharpener of claim 1 wherein said sharpener is a multistage sharpener including one or more of said abrasive surfaced truncated cones sharpening disks modified with its sloping radial side surfaces slightly crowned in a direction perpendicular to the circumferential line of contact made by the edge facet on the rotating abrasive surface.

5. The sharpener according to claim 1 wherein there are at least two stages that are used sequentially to sharpen at least one facet of said blade, the last stage being the finishing stage preceded by a sharpening stage containing a knife angle guide that aligns the face of said knife so that its edge facet is sharpened at a first precisely established angle that is smaller than, but within 3 degrees of the said precisely established angle of the finishing stage.

6. The sharpener of claim 1 wherein the sloping cone shaped surface of said modified truncated cone is crowned with a radius of 8 to 10 inches.

7. The sharpener of claim 1 including at least one non-abrasive stop bar contacted by the edge of the knife blade that serves to position an edge facet in contact with the said rotating abrasive surface disk at that point that causes the rotating abrasive particles on said abrasive surface to cross the linear line of the knife edge at an angle to that edge in the range of 30 to 90 degrees to the line of that edge.

* * * * *